US005534167A

United States Patent [19]

Billman

[11] Patent Number: 5,534,167

[45] Date of Patent: Jul. 9, 1996

[54] CARPET CLEANING AND RESTORING COMPOSITION

[75] Inventor: Fred L. Billman, Racine, Wis.

[73] Assignee: S. C. Johnson & Son, Inc., Racine, Wis.

[21] Appl. No.: 397,740

[22] Filed: Feb. 17, 1995

Related U.S. Application Data

[63] Continuation of Ser. No. 259,211, Jun. 13, 1994, abandoned.

[51] Int. Cl.[6] ..... C11D 3/24; C11D 1/14; C11D 3/20; C11D 3/39

[52] U.S. Cl. ..... 510/280; 510/476; 510/279; 510/461; 510/287; 510/299; 510/303; 510/475

[58] Field of Search ..... 252/173, 170, 252/DIG. 1, DIG. 13, DIG. 14, DIG. 11, DIG. 15, 186.28, 186.29, 95, 103, 104, 550, 552, 553, 554, 558, 559, 172; 134/40; 8/111, 137; 427/393.7, 389; 106/2

[56] References Cited

U.S. PATENT DOCUMENTS

| | | | |
|---|---|---|---|
| 3,335,163 | 8/1967 | Tesoro et al. | 8/120 X |
| 3,382,097 | 5/1968 | Erby et al. | 427/381 |
| 3,450,755 | 6/1969 | Ahlbrecht | 564/96 |
| 3,458,571 | 7/1969 | Tokoli | 564/96 |
| 3,462,294 | 8/1969 | Thomas | 106/2 X |
| 3,535,156 | 10/1970 | Turner | 427/393.4 |
| 3,540,924 | 11/1970 | Rozek et al. | 427/393.4 |
| 3,706,594 | 12/1972 | Wasley et al. | 427/393.4 X |
| 3,810,939 | 5/1974 | Ray-Chaudhuri et al. | 252/555 X |
| 3,901,727 | 8/1975 | Loudas | 8/137 X |
| 3,920,389 | 11/1975 | Eanzel | 252/8.6 X |
| 3,954,660 | 5/1976 | Kennedy et al. | 252/170 X |
| 3,987,227 | 10/1976 | Schultz et al. | 428/91 |
| 3,994,744 | 11/1976 | Anderle et al. | 252/DIG. 2 |
| 4,002,571 | 1/1977 | Anderle et al. | 252/DIG. 2 |
| 4,007,305 | 2/1977 | Kakar et al. | 252/8.6 X |
| 4,013,595 | 3/1977 | Podella et al. | 252/DIG. 2 |
| 4,032,495 | 6/1977 | Perronin et al. | 524/501 |
| 4,043,923 | 8/1977 | Loudas | 252/DIG. 14 |
| 4,145,303 | 3/1979 | Loudas | 8/137 X |
| 4,160,777 | 7/1979 | Loudas | 562/426 X |
| 4,171,415 | 10/1979 | Kleiner et al. | 252/8.6 X |
| 4,203,859 | 5/1980 | Kirn et al. | 252/DIG. 13 |
| 4,264,484 | 4/1981 | Patel | 427/393.4 X |
| 4,304,610 | 12/1981 | Weisensel | 8/137 X |
| 4,311,618 | 1/1982 | Schäfer-Burkhard | 252/171 X |
| 4,313,978 | 2/1982 | Stevens et al. | 252/500 X |
| 4,336,165 | 6/1982 | Weisensel | 252/528 |
| 4,437,928 | 3/1984 | Wong | 252/79.4 X |
| 4,460,374 | 7/1984 | Abel et al. | 8/501 |
| 4,623,683 | 11/1986 | Villarreal et al. | 524/47 |
| 4,681,790 | 7/1987 | Fong | 106/2 X |
| 4,844,952 | 7/1989 | Korenkiewicz et al. | 427/386 X |
| 4,857,392 | 8/1989 | Kirjanov et al. | 427/430.1 X |
| 4,937,123 | 6/1990 | Chang et al. | 252/8.6 X |
| 5,001,004 | 3/1991 | Fitzgerald et al. | 428/263 |
| 5,073,442 | 12/1991 | Knowlton et al. | 106/2 X |
| 5,084,306 | 1/1992 | McLellan et al. | 427/381 X |
| 5,191,306 | 3/1993 | Roberts et al. | 524/831 |
| 5,212,272 | 5/1993 | Sargent et al. | 526/317.1 |
| 5,284,597 | 2/1994 | Rees | 252/DIG. 14 |
| 5,338,475 | 8/1994 | Corey et al. | 252/DIG. 14 |
| 5,439,610 | 8/1995 | Ryan et al. | 252/174.23 |

FOREIGN PATENT DOCUMENTS

| | | |
|---|---|---|
| 610507 | 8/1994 | European Pat. Off. . |
| 93/09216 | 5/1993 | WIPO . |

OTHER PUBLICATIONS

*Solvents Guide*, Marsden, C., et al., Cleaver–Hume Press Ltd., 1963, pp. 111–114, 284–287, 331, 332, 401–403, 464, 465, and 564.

*Primary Examiner*—Douglas J. McGinty

[57] ABSTRACT

An aqueous carpet cleaning composition restores properties of manufacturer finishes to carpeting which is composed of from about 0.5% to about 6.0% by weight of ethylene glycol n-hexyl ether, from about 0.05% to about 2.0% by weight of a water-soluble or water miscible fluorinated hydrocarbon which forms a water and oil repellent surface upon drying; from about 0.25% to about 5.0% by weight of a surfactant selected from the group consisting of nonionic surfactants and mixtures thereof; and from about 0.5% to about 7.0% by weight of a olefinic/acrylic polymer having an acid number from about 10 to about 450. The composition forms a non-tacky, soil repellent residue upon drying and restores the water repellent finish of the carpet.

16 Claims, No Drawings

CARPET CLEANING AND RESTORING COMPOSITION

This is a continuation of application Ser. No. 08/259,211 filed on Jun. 13, 1994, now abandoned.

TECHNICAL FIELD

The present invention relates to the field of carpet cleaning compositions, specifically carpet cleaners which restore carpets to their original manufacturer finishes.

BACKGROUND ART

Almost all modern carpets have finishes to make cleaning easier and to enhance the appearance of the carpet. These finishes are applied by the manufacturer as a final treatment. They include anti-soiling, gloss (or sheen), stainblocking, anti-static, water and oil repellency. Occasionally one or more of these properties is built into the fiber instead of the finish. The most common example of this is anti-static properties.

These finishing treatments are to create what is known in the trade as "Fourth and Fifth Generation" carpets. In North America there are generally three types of carpet materials: nylon, polyester and polyolefin. There are also varying methods of how finishes are applied to these carpet materials which results in different degrees of fourth and fifth generation carpet properties.

The majority of household carpets have a final treatment that gives some type of water and oil repellency. Almost all have excellent oil repellency which means that oils such as cooking oil and motor oil will remain beaded on the surface of the carpet for easy cleaning. Polyolefin carpets, which make up 10% of the market, have no oil repellency. Household carpets also have widely varying degrees of water repellency. Some carpets will bead water for a few seconds. Other carpets will bead water until it dries. Still other carpets, although claiming to have water repellency, have none. Without water repellency, beverage spills will be immediately absorbed into carpets, making the spills difficult to remove and increasing the likelihood of permanent staining. Cleaning carpets having water and/or oil repellency may destroy the repellency unless special cleaners are used or the carpets are rinsed thoroughly.

An additional carpet finish is "soil resistance" or "anti-resoiling". This property prevents subsequent soils from adhering to carpets as a result of normal use such as foot traffic on carpets, thus making vacuuming more efficient. Carpets vary tremendously in their anti-soiling properties. In addition, cleaning a carpet with poorly formulated carpet cleaning solutions containing sticky materials such as oily materials, sticky detergents and water absorbent materials such as hygroscopic salts can leave a residue that would attract dirt or dust. Thus freshly cleaned carpets often do "get dirty faster" than a new carpet.

A further carpet finish is stainblocking. Most modern carpets are dyed with acid dyes after they are finished. The concentration of the dye determines the intensity of the color. After dyeing there are often dye sites available. This means that common colored beverages such as Kool-Aid® or fruit juices that contain acid dyes can permanently dye carpets. However, stain blocked carpets are treated with a special clear dye after dyeing that blocks all of the dye sites thus leaving no place for spilled colored beverage dyes to attach to the carpet. These stain blocked carpets will usually leave light colored spots where spilled colored beverages have dried and the light colored spots can be rinsed completely out with water or a well formulated carpet cleaner.

The gloss or sheen of the carpet is often called the "finish". In fact, this is the only portion of the finish that you can see when you purchase a carpet. This gives a carpet the "luster", "delustered" or "shiny" look. The sheen is an integral part of the formulated finish applied by the manufacturer. The final applied finish determines whether a carpet is "delustered" or has a high gloss. Delustering is common these days because dirt is less visible on carpets with this treatment.

All of the above-described finishes are utilized by carpet manufacturers so that even light colored or white carpets maintain their appearance and are easy to keep clean. Generally, the lighter the carpet's color, the more important these finishes are.

Unfortunately, in cleaning these treated carpets, current carpet cleaners undesirably destroy one or more of the aforementioned finishes, unless thoroughly rinsed. Using large amounts of water when rinsing can have deleterious effects on carpeting, as the padding often will become saturated with water which can result in degradation of the padding and/or carpet. Furthermore, if any of the finishes, such as water repellency, is destroyed during cleaning, the carpet will have to be retreated with additional products.

In addition, many compositions create a powdery or off white finish on the carpet such as the textile treatment compositions described in U.S. Pat. No. 4,043,923 to Loudas.

Further, as one of ordinary skill in the art will appreciate, many of the desired attributes of a carpet cleaning product will interfere with each other. For example, water and oil repellency agents tend to deter anti-resoiling and cleaning properties. In addition, good anti-soiling agents tend to deter water and oil repellency. Further, some additives which are desirable in a consumer product such as fragrance, may cause increased resoiling of carpets.

The difficulty of combining all the desired attributes and cleaning while leaving no visible residue is evidenced by some of the current commercially available carpet care products. For example, Woolite® spray product, from Reckeli & Coleman, has good cleaning properties but exhibits inferior anti-resoil properties, has no stainblocking properties and eliminates the water and oil repellency finishes of carpets unless it is thoroughly rinsed.

Accordingly, it is an object of the present invention to provide an effective carpet cleaning composition which restores the factory finishes to the carpet fibers without saturating the carpet with a rinsing agent.

An additional object of the present invention is to provide an effective carpet cleaning composition which leaves good water repellency and utilizes a reduced amount of fluorinated hydrocarbons.

It is a further object of the present invention to provide an effective carpet cleaning formulation with cleaning and restoring properties having minimal or no interference with each other.

These and other objectives will become apparent to one of ordinary skill in the art from the Specification and claims of the present invention.

SUMMARY OF THE INVENTION

The present invention achieves the above-numerated objectives by providing a carpet cleaning composition which provides excellent cleaning and stain removing properties which surprisingly restores the gloss, stain resistance, anti-resoiling and oil and, most important, the water repellency features of the original factory finish to a carpet after completely drying. The carpet cleaning compositions of the present invention generally comprise:

(a) from about 0.50% to about 6.0% by weight of ethylene glycol n-hexyl ether;

(b) from about 0.05% to about 1.0% by weight of a water-soluble or water miscible fluorinated hydrocarbon which forms a water and oil repellent surface upon drying;

(c) from about 0.25% to about 5.0% by weight of a surfactant selected from the group consisting of anionic surfactants, nonionic surfactants and mixtures thereof;

(d) from about 0.5% to about 7.0% by weight of a olefinic/acrylic polymer having an acid number of about 10 to about 450; and (e) the balance water, wherein the composition forms a non-tacky residue upon drying. Optionally these compositions may include other components which optimize the stain removal, stain blocking, fragrance and other desirable characteristics of the composition.

DETAILED DESCRIPTION OF THE INVENTION

The compositions of the present invention provide good water and oil repellency to carpets with poor original repellency and some repellency to carpets with no manufacturer-applied repellency finishes.

The present invention also possesses improved stain blocking properties. Therefore, treating a carpet with the composition may provide the user with stain blocking equal or better to a new carpet having a manufacturer's applied stain blocker.

The carpet cleaning and restoring compositions of the present invention generally comprise:

(a) from about 0.50% to about 6.0% by weight of ethylene glycol n-hexyl ether;

(b) from about 0.05% to about 1.0% by weight of a water-soluble or water miscible fluorinated hydrocarbon which forms a water and oil repellent surface upon drying;

(c) from about 0.25% to about 5.0% by weight of a surfactant selected from the group consisting of anionic surfactants, nonionic surfactants and mixtures thereof;

(d) from about 0.5% to about 7.0% by weight of an olefinic/acrylic polymer having an acid number of about 10 to about 450;

(e) the balance water, wherein the composition forms a non-tacky residue upon drying.

The compositions of the present invention provide soil repellency or "anti-resoil" at least equivalent to an uncleaned new carpet.

The cleaning composition of the present invention contains a sufficient amount of ethylene glycol n-hexyl ether ("EGHE" )to provide enhanced cleaning and to maximize the repellency achieved by the fluorinated hydrocarbon component. EGHE is available from Union Carbide under the trade name "Hexyl Cellosolve."

Typically, from about 0.5% to about 6.0%, preferably from about 1.0% to about 4.0%, and most preferably about 2.0% to about 3.5% by weight of EGHE is used in the present invention.

The importance of utilizing EGHE in the compositions of the present invention is illustrated by the following example. When EGHE was replaced with diethylene glycol monobutyl ether ("EGBE") in the formulations of the present invention, even to EGBE levels as high as 5.0% by weight, stable, integrated formulas could not be achieved. Unexpectedly, stable systems were achieved when at least about 0.5% by weight EGHE was present in the formulations.

Optionally, a co-solvent may be used in combination with EGHE to produce compositions of the present invention. The co-solvent may be any water miscible or water-soluble organic solvent. The co-solvent component of the present invention is preferably an $C_1$–$C_5$, $C_7$–$C_{12}$ alkyl glycol ether. Most preferably the co-solvent is selected from the group consisting of diethylene glycol monohexyl ether, EGBE, isopropyl alcohol and mixtures thereof. Diethylene glycol monohexyl ether is available under the trade name Hexyl Carbitol from Union Carbide. EGBE is available from Union Carbide under the trade name Butyl Cellosolve.

The co-solvent is typically present in amount from about 0% to about 6.0%, preferably from about 0.5% to about 3.0%, and most preferably from about 1.5% to about 2.5% by weight of the compositions of the present invention.

The polymer component of the present invention contributes to both the oil and water repellency, provides gloss to the cleaned carpet, and maximizes the anti-resoiling features of the compositions of the present invention. In addition, the polymer component assists in solubilizing relatively insoluble ingredients, thus assisting in the formation of a carpet cleaning product having integrated properties.

Generally, the polymer component is a water-bourne polymer used in solubilizing organic materials. Many of these polymers are currently utilized in the graphic arts and paint industries. Preferably, the polymer component of the present invention is an olefinic/acrylic polymer.

Olefinic/acrylic polymers comprise a combination of alpha, beta unsaturated carboxylated monomers, and olefinic monomers such as styrene, alpha methyl styrene ("AMS" ) or blocked alpha, beta unsaturated esterified carboxylates or amides. Blocked carboxylated polymers do not liberate acid or acid salt groups during solubilization, therefore do not alter the final AN of the polymer. Carboxylated monomers contribute to the acid number ("AN" ) of the final polymer. The carboxylated monomers are typically available as a free acid, anhydride or hydrolyzable ester. Preferably, the carboxylated polymer is an ammonium or sodium salt. More preferably, the final polymer may be dissolved into water with an alkali to form a polymer having an AN of about 10 to about 450, preferably from about 20 to about 350. The AN is based upon non-volatile solids (actives) content of the polymer.

Most preferably, the polymer component is an olefinic/acrylic polymer cut into solution with ammonia, which has as one of its monomers an unsaturated organic acid such as acrylic or maleic acid at such a ratio so as to have a final acid number of about 10 to about 450, preferably from about 20 to about 350. The salt of the preferred polymer is soluble in water and dries to a non-tacky residue in the final composition. Most preferably the salt is ammonium or sodium salt.

The most preferred polymers are olefinic/acrylic solutions having 60% styrene/AMS/acrylic resin, having a molecular weight ("Mw") 1,700, a glass transition temperature ("Tg") of 56° , and AN of 238; 34% styrene/AMS/acrylic resin, Mw 8,500, Tg of 85° C., AN of 215; 30.5% styrene/AMS/acrylic resin, Mw 12,500, Tg of 73° C., AN of 213; and olefinic/acrylic polymer emulsions such as 45.5% styrene/AMS/2-ethyl hexylacrylate/acrylic acid ("AA"), Mw>200,000, Tg of 7° C., AN of 50; 45% styrene/AMS/AA/methyl methacrylate ("MMA")/butyl methacrylate ("BMA")/butyl acrylate, Mw>200,000, Tg of 64° C., AN of 53; and about 98% solid styrene and AMS/acrylic resin which is cut into solution with 28% ammonia to pH of 7.85, Mw 17,000, Tg of 85° C., and AN of 175. All of the aforementioned polymers are utilized as alkali cuts wherein the polymer is completely dissolved or emulsified in water. Molecular weight ("Mw") indicates the weight average of the polymer component.

Other similar polymers can be substituted for the aforementioned polymers in the carpet cleaning and restoring compositions of the present invention so long as they meet the criteria set forth above. For example, some stainblocking compounds which provide oil and water repellency may be used as the polymer component or in combination with the polymer component in the present invention. Such stainblockers generally include carboxylated polymer salts. Useful stainblocking components include those described in U.S. Pat. Nos. 4,937,123 to Chang et al. and 5,001,004 to Fitzgerald et al. Preferably the stain blocking agent is a low molecular weight carboxylated water soluble polymer (below molecular weight of 10,000) which may or may not contain some sulfonated material such as sulfonated castor oil, or formaldehyde/sulfonated phenol condensate. Most preferably the stain blocking agent is a carboxylated polymer such as Zelan 338 (AN of 196) from DuPont, Fluorad™ FC-661 (AN of 512) from 3M and FX-657 (AN of 427) from 3 M.

The polymer component, which can include the stainblocking polymers, is generally present in an amount from about 0.1% to about 7.0%. preferably from about 1.0% to about 4.0%, and most preferably about 2.5% to about 3.5% by weight of the compositions of the present invention.

The surfactant component of the present invention assists in the cleaning operations of the invention. Generally nonionic, anionic surfactants or mixtures thereof may be in the aqueous formula of the present invention which leave nontacky or non-sticky residue upon drying in the final formula.

Unexpectedly, surfactants which leave a sticky residue, if tested alone, may be used in the formulation of the present invention. When used, these surfactants are in the final formula containing polymers, the final air dried residue is not sticky or tacky to the touch and must have equal or better resoiling (anti-resoiling) when applied and dried, than the carpet before application of product. Sticky surfactants that can be utilized include block co-polymers of propylene oxide and ethylene oxide such as Pluronic L64 from B.A.S.F.

Suitable anionic surfactants for use in the compositions of the present invention include alkali metal or ammonium salts of fatty acids, alcohol sulfates, alcohol sulfonates, alcohol phosphates, alcohol phosphonates, alkyl sulphonates, alkyl sulphonates; disodium lauric sulfosuccinate, disodium lauramido MEA sulfosuccinate and mixtures thereof. The preferred anionic surfactant is ammonium or sodium lauryl sulfate. The disodium lauric sulfosuccinate is available under the trade name Mackanate LO from the Mcintyre Group. Disodium lauramido MEA sulfosuccinate is available under the trade name Mackanate LM 40 from the Mcintyre Group.

Suitable nonionic surfactants for use in the present invention include ethoxylated long chain alcohols, propoxylated/ethoxylated long chain alcohols such as Poly-Tergents from Olin Corp. and Plurafac from BASF Corp.; ethoxylated nonylphenols, such as the Surfonic N Series, available from Texaco; the ethoxylated octylphenols, including the Triton X Series, available from Rohm & Haas; the ethoxylated primary alcohol series, such as the Neodols, available from Shell Chemical; and the ethylene oxide propylene oxide block with polymers such as the Pluronics available from BASF Corp. and mixtures thereof.

Preferably, the nonionic surfactants include primary alcohol ethoxylates, particularly, primary alcohols having 4 moles of ethylene oxide which are available under the trade name Surfonic L24-4 from Texaco or Neodol 23-4 from Shell Oil Corp. Further preferred surfactants include short chain primary alcohols, which are propoxylated and ethoxylated such as Poly-Tergent SL-22 from Olin Chemical Co.

Additional preferred nonionic surfactants include ethoxylated nonylphenols having a degree of ethoxylation of from about 3 to about 20; polymeric ethylene oxides; linear alcohol ethoxylates having a degree of ethoxylation of from about 3 to 20; and mixtures thereof. Polymeric ethylene oxides are available under the trade name Pluronics from BASF. Most preferably the surfactant system is selected from the group consisting of ethoxylated nonylphenols having a degree of ethoxylation of about 6, available under the trade name Surfonic N60; linear ethoxylated alcohol having 4 moles ethylene oxide available under the trade name Surfonic L24-4; block co-polymers propylene oxide and ethylene oxide available under the trade names Pluronic F127, a block co-polymer of propylene oxide, and ethylene oxide terminating in primary hydroxyl groups with an average molecular weight of 2,900, a specific gravity of 1.05 (25°/25° C.), a viscosity of 850 cps at 25° C, a pour point of 16° C., a cloud point (1% aqueous) of 58° C. and a surface tension (0.1% aqueous) of 43 dynes/cm at 25° C.; and Pluronic L-64; an ethoxylated/propoxylated short chain linear alcohol available under the trade name Polytergent SL-22 and mixtures thereof.

Other similar nonionic surfactants can be substituted for the aforementioned surfactants in the soft-surface cleaners of the present invention so long as they meet the criteria set forth above.

The surfactant component is typically present in an amount from about 0.25% to about 5.0%, preferably from about 0.25% to about 3.5%, and most preferably about 0.25% to about 2.5% by weight of the compositions of the present invention.

Nonionic surfactants may be used in combination with anionic surfactants in the present invention. Preferably the mixture of anionic and nonionic surfactants comprise from about 0.25% to about 1.0% by weight of an ethoxylated nonylphenol having a degree of ethoxylation of about 6, and from about 0.25% to about 1.0% by weight of ammonium lauryl sulfate or sodium lauryl sulfate.

The '923 patent to Loudas discusses the use of such surfactants in a ratio of about 1:2 surfactant to fluorinated hydrocarbon. However, one of ordinary skill in the art would expect that increasing the amount of surfactant would interfere with the repellency properties of the composition and would cause wetting of water instead of repellency of water. Surprisingly, the compositions of the present invention utilizing highly increased levels of surfactants achieve improved cleaning without reducing the oil and water repellency attributes of the formulations. The ratic, of surfactant to fluorinated hydrocarbon is at least 1:1, while the preferred ratio of surfactant to fluorinated hydrocarbon may be as high as 40:1.

The fluorinated hydrocarbon component of the present invention provides water and oil repellency to the carpets. Water repellency is a key feature in carpeting since the majority of spills on carpets are aqueous based materials.

Water repellency makes these spills easier to blot and clean up with a lower probability of permanent stains left on the carpet, because the spill will remain on the carpet surface, instead of immediately wicking into the fibers and padding.

The fluorinated hydrocarbon component of the present invention is generally capable of dissolving in a water-soluble or water-dispersible organic solvent, and are compatible with the anionic and nonionic surfactants of the present invention. These fluorochemical compounds such as those described in U.S. Pat. No. 4,043,923 to Loudas, are capable of dissolving in an organic solvent, preferably in a water-soluble or water-dispersible organic solvent.

Generally, the detergent-compatible, organic or water solubilizable fluorinated hydrocarbon compounds will contain about 10 to 60 weight percent, preferably about 15 to 45 weight percent, of carbon-bonded fluorine. If the fluorine content is less than about 10 weight percent, these compounds may no longer be detergent compatible, while compounds having fluorine contents greater than about 60 weight percent are uneconomical to use. Most preferably, the fluorinated hydrocarbon component is a 28% by weight mixture of $C_6$ and $C_8$ perfluoroalkyl derivative available from 3M under the trade designation L-12357.

Typically, the fluorocarbon is present in an amount from about 0.05% to about 1.0%, preferably, from about 0.1% to about 0.5%, and most preferably, from about 0.15% to about 0.4% by weight.

Water is also generally present in an amount from about 60% to about 98%, preferably, about 70% to about 97% by weight of the composition and most preferably, from about 80% to about 96% by weight of the compositions.

The final pH of the compositions of the present invention is from about 6 to about 10, preferably from about 6 to about 9.

The cleaning and restoring compositions of the present invention may also optionally include peracids and peroxides to assist in the overall cleaning performance of the compositions.

Compositions containing peracids and peroxides should be dispensed from nonreactive containers. Suitable peroxides include hydrogen peroxide, T-butyl hydroperoxide, peracetic acid, acid and percarbonates. Hypochlorites will bleach carpet dyes thus damaging nylon carpets and are, therefore, not suitable in carpet cleaning formulations of the present invention. Preferably, the peroxide is hydrogen peroxide.

The peroxide or peracid is typically present in an amount from about 0.0% to about 8.0%, preferably about 0.3% to about 5.0%, and most preferably, from about 0.5% to about 3.0% by weight of the composition.

The cleaning and restoring compositions of the present invention may also include components which enhance the effectiveness, the physical appearance, or the fragrance and inhibit corrosion of the container for the compositions. These optional components include perfumes, chelating agents, germicidal agents and corrosion inhibitors. Each of these components are typically present in an amount from about 0% to about 2.0% by weight of the composition.

The compositions of the present invention are also suitable for use in aerosol compositions. Typical aerosol compositions include from about 80.0% to about 99.5% by weight of the composition of the present invention and from about 0.5% to about 20.0% by weight of a propellant. Any of the typical aerosol propellants, such as hydrocarbon, halogenated hydrocarbon and compressed gases, can be used. Suitable propellants include propane, butane, isobutane, pentane, propellant 11, propellant 12, propellant 14, and the like. Preferred propellants are the hydrocarbon propellants.

The compositions of the present invention can be prepared by an conventional means. Suitable methods include cold blending or other mixing processes.

The cleaning and restoring compositions of the present invention will now be illustrated by the following examples and comparative examples, wherein all parts and percentages are by weight and all temperatures in degree Celsius unless otherwise indicated.

Aerosol Formulation Intermediate

| % by wt. | Materials |
|---|---|
| 0.25% | Ethoxylated nonylphenol, 6 moles EO (Surfonic N60) |
| 2.5% | Ethylene glycol n-hexyl ether (Hexyl Cellosolve) |
| 1.0% | Polyoxy Propylene-Polyoxyethylene Block Copolymer (Pluronic L-64) |
| 1.0% | Ammonium Lauryl Sulfate (28% Active) |
| 0.1% | Perfume |
| 0.5% | Zelan 338 (30% Active Carboxylated Polymer, AN 196) |
| 1.0% | L-12357 (0.28% Fluorinated hydrocarbon) |
| 0.25% | Corrosion inhibitor |
| 10.0% | 30.5% Aqueous Ammonia cut of styrene/AMS/acrylic resin, Mw 12,500, Tg 73° C., AN 213 |
| 83.4% | Deionized water |
| 100.0% | |

Final Aerosol

| | |
|---|---|
| 97% | Intermediate |
| 3% | Propellant (isobutane/propane, 80/20 mol % blend) |
| 100% | |

Trigger Spray Formula

| % by wt. | Material |
|---|---|
| 0.25% | Ethoxylated/propoxylated short chain linear alcohol (Poly-Tergent SL22) |
| 2.5% | EGHE (Hexyl Cellosolve) |
| 2.0% | Ammonium Lauryl Sulfate (30% Active) |
| 0.1% | Perfume |
| 0.5% | Zelan 338 (30% Carboxylated Polymer, AN 196) |
| 1.0% | L-12357 (28% Fluorinated Hydrocarbon) |
| 4.45% | 45% Aqueous ammonia cut of a styrene/AMS/acrylic polymer; Mw > 200,000; Tg 64° C., AN 53 |
| 3.30% | 30.5% Aqueous ammonia cut of a styrene/AMS/acrylic polymer, Mw 12,500; Tg 73° C., AN 213 (pH 9) |
| 85.90% | Deionized water |
| 100.0% | |

Trigger Spray Formula II

| % by wt. | Material |
|---|---|
| 0.25% | Ethoxylated Nonylphenol, 6 Moles EO (Surfonic N60) |
| 3.5% | EGHE (Hexyl Cellosolve) |
| 1.0% | 30% Ammonium Lauryl Sulfate |
| 1.0% | Polyoxypropylene-Polyoxyethylene Block Polymer (Pluronic L64) |
| 2.0 | 26% Carboxylated Polymer, AN 512 (Fluorad FC-661) |
| 1.0% | L-12357 (28% Fluorinated hydrocarbon) |
| 0.1% | Perfume |
| 10.0% | 30.5% Aqueous ammonia cut of a styrene/acrylic |

-continued

| Trigger Spray Formula II | |
|---|---|
| % by wt. | Material |
| | polymer, Mw 12,500; Tg 73° C., AN 213 (pH 9) |
| 81.15% | Deionized Water |
| 100.00% | |

The following cleaning protocol was utilized to evaluate the cleaning performance of the above aerosol and Trigger Spray Formula II compositions on white or off-white colored 100% nylon carpeting as compared to representative commercially available aerosol and trigger spray carpet cleaners. Representative aerosol formulas include Scotch Guard Rug and Carpet Cleaner from 3M and Resolve from Lehn & Fink. Representative trigger spray formulas were Carpet Science from S.C. Johnson & Son, Inc. and Resolve from Lehn & Fink and Woolite trigger from Reckett & Coleman. There are three components to the cleaning protocol: stain application, compression cleaning and scoring the cleaning results. The cleaning protocol was performed as a blind study, avoiding bias in cleaning and scoring.

Six stains were chosen for the cleaning protocol. These included: 20% slurry of Brandy Black Research Clay (representing mud); used motor oil; Kraft Catalina salad dressing; chocolate (Hershey's Syrup diluted 1/1 with Deionized water); coffee, a (5% deionized water solution of Maxwell House Instant Coffee); and Welch's 100% Grape Juice. These stains were chosen to represent all classes of stains, i.e., particulate matter Brandy Clay (mud) and Catalina Salad Dressing (tomato parts), dirty motor oil contains suspended particles; oils/fats—Catalina Salad Dressing (contains soybean oil) and artificial dyes, Hershey's syrup contains mono- and diglycerides from vegetable oils, dirty motor oil; Grape juice and Coffee contain Lipophillic dyes; Water soluble dyes - Grape Juice and Coffee.

Stains were applied with a sponge type blotter, with the exception of Catalina Dressing. Catalina was applied with a pipette and was spread evenly with spatula on the carpet surface. The staining materials were applied in the following amounts:

| | |
|---|---|
| Clay (Mud) | 0.5–0.7 g. |
| Chocolate | 0.5–0.7 g. |
| Coffee | 1.0–1.3 g. |
| Grape Juice | 1.0–1.3 g. |
| Oil | 0.4–0.6 g. |
| Catalina Dressing | 0.6–0.7 g. |

The amount of stain applied was carefully weighed with a Mettier balance. Round sponge type blotters, 3.75 cm in diameter and 0.125 cm thick, were used to apply the stains.

Stains were applied to white and light colored carpet. This made the stains easier to evaluate. Three sets of six stains were applied to the carpet for each experimental carpet cleaning formula. Stains were allowed to dry for about 24 hrs. at room temperature of about 20° C. and ambient laboratory humidity of approximately 50% relative humidity before cleaning was performed.

Compression cleaning was performed with the use of sponge blotters. Blotters were soaked with cleaner and pressure is applied directly to the blotter to express cleaner into the carpet. The cleaner was then blotted dry with paper toweling.

More specifically, for the trigger spray formulations, a sponge blotter, 5 cm in diameter and 0.25 cm wide, was soaked with about 7.0 g cleaning formula. The formula soaked blotter was placed directly over the stain. A 75 cm×15 cm piece of grooved cobalt glass was placed directly over the sponge blotter with groves down. Direct pressure in a downward direction was then applied to the cobalt glass for 1–2 seconds by stepping on the glass with one foot. Ten compressions were performed for each stain.

The cobalt glass and sponge were then removed, wherein only about one gram of product remained in the sponge and approximately six grams were delivered to the carpet. The stain was blotted dry by first placing paper toweling (Teri wipers) over the stain. Four blots for each stain were executed by stepping on the paper towel over the stain for 2–3 seconds with complete body weight on one foot.

When the compression cleaning was complete, the carpet was raked and allowed to dry for 24 hours. Each group of three sets of stains was blind labeled. The identity of the products were not revealed until the stain grading was completed.

The dry stains were rated about 24 hours alter cleaning was completed. A five point scale in increments of 0.5 units was used to evaluate cleaning. If a stain was removed completely, a score of 5.0 was given to the stain; if the stain was equal to the original, or worse, a rating of 0 was given. Stains were rated as a group; such that three stains were given one score. Groups of stains were rated in relation to all other groups of stains in the scoring process. One person provided initial ratings to the stains and another person reviewed the ratings for possible discrepancies.

Each score was then recorded for each group of stains. Scores for all six types of stains were summed and a composite score was given to each carpet cleaning formula. The superior overall cleaner has the highest score.

For the aerosol formulations, the cleaning test was performed as above except for the following: A 3 to 4 gram quantity of aerosol was sprayed directly onto the stain and a one gram quantity of aerosol was carefully sprayed onto the sponge wafer. After waiting 10 minutes this treated sponge wafer was then applied to the foam treated stain and pressed with a grooved 7.6 cm×15.2 cm piece of cobalt glass, grooved side facing the sponge, by putting your complete body weight on one foot on the glass for 1 to 2 seconds 10 times. Since the cleaning technique is different for the two types of products, cleaning comparisons between aerosol and trigger products are not possible.

Scores from one test are comparable only when the same standard is used in both tests. Different carpets and different carpet finishes have different cleaning properties making indirect cleaning score comparisons meaningless without internal standards. In addition, rubbing stains such as consumers ordinarily do introduces a very large error which the above-described blotting technique minimizes.

Water/Oil Repellency Test

Comparative testing was performed to show the water and oil repellency of carpet treated with the cleaning and restoring compositions of the present invention as compared to other current aerosol and trigger spray household cleaning products. The tests were conducted as follows:

Two clean pieces of 100% nylon carpet, one piece treated with DuPont Stainmaster® with good water and oil repellency and the other piece having poor water repellency were divided into many small 10 cm×10 cm squares using masking tape. Each product was tested twice on each carpet, once as two squirts (about 2 ml) approximating an aerosol application, and a second time as 6 squirts (about 6.0 ml)

representing a trigger type product. Immediately after application, the squares were scrubbed using a soft bristle surgical scrub brush for approximately 10 seconds in order to assure uniform application. The carpets were then allowed to dry for approximately 48 hours at room temperature of about 20° C. and under ambient laboratory humidity conditions of about 50% relative humidity. These same tests were repeated for carpets that had been resoiled by using the resoil test described herein. This test was done to determine repellency after simulated wear or in home use. Then, the following repellency tests were performed:

Test 1: Water Repellency

Three drops of a solution comprising about 0.002% by weight of a yellow water soluble dye such as FD&C Yellow No. 5 were dropped onto a treated area from a distance of approximately 1 cm or less using a disposable pipette, with the object of having the liquid bead perfectly in a spherical fashion on the carpet surface. After the droplets were placed on the carpeting, the length of time the drops remained on the surface of the carpet was measured. The water repellency was rated on a scale of 0 to 2.5+ as follows:

2.5+=drops remained spherical or nearly spherical on the surface for more than 30 minutes. No darkening (wetting) shown under droplet.

2.5 =Visible liquid (not spherical or nearly spherical) remained on the surface. Water droplet flattened out but liquid is still visible on the surface. Some darkening may show under the droplet. Droplets were easily and completely blotted up with paper towels.

2.0 =drops remained spherical on surface for about 5 minutes, but wicked into the carpet before 30 minutes.

1.5 =visible liquid on surface for about 5 minutes to about 30 minutes.

1.0 =visible liquid on surface for 2 minutes to about 5 minutes.

0.5 =visible liquid on surface for 1 min. to about 2 minutes.

0.0 =wicked into the carpet in less than 1 minute.

CHART IA

Comparative Examples of Post-Cleaning Restorative Finish Properties of Aerosol Carpet Cleaning Compositions

| | REPELLENCY | | | RESOIL | | STAINBLOCKING | | |
|---|---|---|---|---|---|---|---|---|
| Formula/ Product | Water Repellency After Resoil | Alcohol Repellency After Resoil (10% IPA) | Oil Repellency After Resoil | Resoil for a Poor Anti-Resoil Carpet | Resoil for a Good Anti-Resoil Carpet | Stainblocking for a Good Stain-blocked Carpet | Stainblocking for a Poor Stain-blocked Carpet | CLEANING CLEANING |
| Blank | 2.5 | 2.5 | 2 | 0 | 0 | 5 | 2.5 | 0 |
| Aerosol of the present invention | 2.5 | 2.5 | 3 | 1 | 0.5 | 4 | 2.5 | 19 |
| Resolve Aerosol | 0 | 0 | 5 | 0 | 0 | 5 | 2 | 10 |
| Scotch Guard Rug and Carpet Cleaner - Aerosol | 0 | 0 | 5 | 2 | 2 | 4.5 | 2.5 | 16.5 |

CHART IB

Comparative Examples of Post-Cleaning Restorative Finish Properties of Trigger Spray Carpet Cleaning Compositions

| | REPELLENCY | | | RESOIL | | STAINBLOCKING | | |
|---|---|---|---|---|---|---|---|---|
| Formula/ Product | Water Repellency After Resoil | Alcohol Repellency After Resoil (10% IPA) | Oil Repellency After Resoil | Resoil for a Poor Anti-Resoil Carpet | Resoil for a Good Anti-Resoil Carpet | Stainblocking for a Good Stain-blocked Carpet | Stainblocking for a Poor Stain-blocked Carpet | CLEANING CLEANING |
| Blank | 2.5 | 2.5 | 2 | 0 | 0 | 5 | 2.5 | 0 |
| Trigger Spray Formula II | 2.5 | 2.5 | 4 | 2 | 0.5 | 4.5 | 3.5 | 14 |
| Carpet Science Trigger | 0 | 0 | 0 | 1 | 0.5 | 3.5 | 1 | 17 |
| Resolve Trigger | 0 | 0 | 5 | 0.5 | 0.5 | 5 | 1.5 | 15 |
| Woolite Trigger | 0 | 0 | 0 | (−1.5) | (−3) | 2 | 0 | 12.5 |

Test 2: Alcohol Repellency

The treated carpet areas were subjected to the condition of Test I using an isopropanol/water (10%/90% by volume) solution ("IPA solution"). An IPA solution is relatively more difficult to "bead tip" than water. The test results are shown in Charts IA and IB indicate that both aerosol and trigger spray formulations restore the aqueous alcohol repellency finishes of the carpeting while the other products did not maintain any aqueous alcohol repellency.

Test 3: Oil Repellency

The test for oil repellency which is similar to the method described in AATCC Test No. 118-1966T, consisting of applying a few drops of liquids having different surface tensions to the treated carpet was performed on the carpet samples. The test liquids were as follows:

1) mineral oil
2) 65:35 ratio by volume of mineral oil/hexadecane
3) hexadecane
4) tetradecane
5) dodecane
6) decane
7) octane
8) heptane Mineral oil has the highest stirface tension in the series and was the easiest to form a bead. Heptane has the lowest surface tension in the series, and was the most difficult to bead.

To test the treatment for oil repellency a few drops of the lowest numbered liquid in the series was applied to the treated carpet square. The drops were observed for approximately 30 seconds at an angle of approximately 45°. If the liquid did not bead, the cleaner has "0" oil repellency. If the liquid beaded on the treated carpet, the next numbered liquid in the series (in decreasing molecular weight order) was applied onto a treated square until the highest numbered oil which would remain on the surface of the carpet, not necessarily bead perfectly, and not soak in. The liquid repellency score corresponds to the highest numbered oil which was repelled by the treated area on the carpet. In all tests, it was found that a score of 1 or higher with this test gave repellency for cooking and used motor oil. Thus, cooking oil and used motor oil remained on the surface with no visible wicking into the carpet upon their placement on the treated surface, when a score of 1 or higher was obtained from this test.

The oil repellency scores recorded in Chart 1 show that the carpet cleaning compositions of the present invention achieved equivalent repellency to newly treated carpets.

Resoil Test

Resoil is an important consideration for carpet cleaning compositions as the objective is to leave the carpet in a restored state after cleaning.

Typically carpet cleaners will leave a residue after drying. This residue will eventually repel dirt, attract dirt or simply remain the same shade as the untreated carpet surrounding the treated area. Resoil tests were designed to determine what kind of residue a carpet cleaner leaves on a carpet. For example, Woolite® Tough Trigger Formula from Reckett and Coleman Inc. leaves a very sticky residue after drying. This residue eventually attracts dirt, resulting in the slow development of a spot on the carpet where the stain was removed. Regular household cleaners such as laundry, dish or all purpose will leave the same type of sticky residue.

The objective of the resoil test was to show how well the anti-resoil of the cleaning compositions last after about one month to one year of wear as compared to a bland or untreated carpet. Untreated carpet that is new carpet that has not been cleaned.

Carpet pieces of both good and poor anti-resoil, 100% nylon carpet were cut to the dimensions of about 45 cm×92 cm. These pieces are sectioned off by 2.5 cm wide masking tape into 8 cm×25 cm rectangular areas. Each product to be tested was applied at 2 levels of application of about 2 g. (2 sprays from a 1.0 m. Carpet Science trigger) representative of an aerosol application, and about 9 g (9 sprays from a Carpet Science trigger), representative of a trigger cleaning application. These applied products were scrubbed lightly for approximately 10 sec. with a surgical scrub brush to assure uniform application and allowed to dry for 48 hours, at ambient laboratory conditions of about 20° C. and about 50% relative humidity.

Next, the backs of the carpets were marked to indicate the location of the various products tested on each section of the carpet. A piece of double-sided tape was applied along the top of one of the 46 cm ends of the carpeting. Before placing each carpet into the resoil machine, the masking tape was removed from the carpet. The resoil machine consisted of a cylinder having the interior dimensions of 45.7 cm high and a inner circumference of 92 cm. The cylinder was mounted on a rod through the center. The cylinder has a hole with a diameter of about 30 mm on its side for inserting a soil sample.

The carpet was secured in the cylinder using the double sided tape to adhere the carpet to the inside wall of the cylinder with the carpet fibers facing towards the inside of the cylinder. About 3 liters (8 kg) of rounded pebbles, each having a diameter of approximately to 21.0 cm, was poured onto the told of the carpet. After closing the machine, approximately 100 g of filtered vacuum cleaner dirt was inserted through the hole on the side of the cylinder and uniformly applied along with the 45.7 cm length of the cylinder via a plastic corner protector about 6.0 cm long, shaped like a V with dimensions of about 2 cm per side and about 2.25 cm open across the top. This corner protector was filled uniformly from one capped end to 45.7 cm with the 100 g. of filtered vacuum cleaner dirt.

Once the dirt was applied, the resoil machine was run forward for 5 minutes, and 5 minutes in reverse, on a speed of 10 revolutions per minute to simulate approximately about one month to about one year of wear on a household carpet, depending upon the amount of foot traffic. The carpet was then removed from the machine, raked, using a carpet rake, and then photographed.

The resoil results were analyzed on a scale of −5.0 to +5.0 in increments of 0.5 units. A score of −5.0 indicated that the spot was extremely dark, darker than the shade of untreated carpet. 0 indicated neutral (the shade of the soiled, untreated carpet) and a score of +5.0 indicated that the spot was equal to the color of the new, non-soiled carpets. For both poor anti-resoil carpets and good anti-resoil carpets the untreated ("Blank") carpet was rated "0". Positive ratings indicate that the product had better resoil (lighter) than the untreated carpet. A score of 5 would indicate that the product had no resoil. That is, the carpet looked like a new carpet. The results of the resoil test are listed in Chart 1:

As shown in Chart IB, the Trigger Spray Formula II composition of the present invention demonstrated resoil capabilities at least equal to the original new carpet and superior to Woolite& Tough Trigger formula.

Stain blocking Test

Nylon carpets are designed to be dyed after they are made. They are dyed with normal acid dyes. The intensity of the color depends on the concentration of the dye. Many beverages, particularly red beverages such as Kool-Aid& contain acid dyes which when spilled onto the carpet and allowed to dry can permanently dye the carpet. In order the prevent this beverage dyeing of carpets, carpet manufacturers apply a clear dye after the carpets have been dyed, to cover the unused dye sites. These clear dyes are called stainblockers. Stainmaster® by DuPont is a well-known nylon carpet treated with "stainblockers".

Colored beverages spilled on good stain blocked carpets will not permanently dye the carpet. Instead, the stains can be easily rinsed out with water. Unfortunately, these stainblockers can be removed by wear from foot traffic or neutralized by cationic materials, cleaning with caustic agents above pH 9 and sometimes neutralized by cleaning.

Product was applied in the same manner as it was for resoil testing and allowed to dry for 48 hrs. under normal laboratory conditions of 20° C. and 50% relative humidity.

After drying, three spots consisting of 10 ml of red cherry Kool-Aid® were applied to the carpet via a 2.5 cm diameter test tube as three circular spots in each of the 8×25 cm treated areas, and allowed to dry for approximately 24 hours at a room temperature of 20° C. in ambient laboratory humidity of approximately 50%. The following day, the spots were rinsed with warm running water at approximately 25° C. for 10 minutes while gently rubbing the spots with fingers. The stainblocking test results are listed in Chart 1.

The test results demonstrate that the carpet cleaning and restoring compositions of the present invention provide stain blocking properties to a cleaned carpet which are essentially equivalent to that of a new carpet. The compositions restore the water repellency finish while maintaining the other desired attributes of the carpeting. None of the other tested commercial carpet cleaners restored water repellency. Even Scotch Guard from 3M did not restore water repellency after the carpet was resoiled.

Industrial Applicability

Therefore, the carpet cleaning compositions of the present invention restore the original manufacturer finish including the important and difficult to obtain water repellency properties.

The water repellency is obtained by utilizing reduced amounts of fluorinated hydrocarbons and with no rinsing.

Other modifications and variations of the present invention will become apparent to those skilled in the art from an examination of the Specification. Therefore, other variations of the present invention may be made which fall within the scope of the appended claims even though such variations were not specifically discussed above.

What I claim is:

1. A carpet cleaning and oil and water repellency restoring composition comprising:

(a) from about 0.50% to about 6.0% by weight of ethylene glycol n-hexyl ether;

(b) from about 0.05% to about 1.0% by weight of a water-soluble or water miscible fluorinated hydrocarbon which forms a water and oil repellent surface upon drying;

(c) from about 0.25% to about 5.0% by weight of a surfactant selected from the group consisting of anionic surfactants, nonionic surfactants and mixtures thereof;

(d) from about 0.1% to about 7.0% by weight of a olefinic/acrylic polymer having an acid number of about 10 to about 450 and selected from the group consisting of i. 60% styrene/alpha methyl styrene/acrylic resin, having a molecular weight 1,700, a glass transition temperature of 56°, and acid number of 238;

ii, 34% styrene/acrylic methyl styrene/acrylic resin, molecular weight 8,500, glass transition temperature of 85° C., acid number of 215;

iii, 30.5% styrene/alpha methyl styrene/acrylic resin, molecular weight 12,500, glass transition temperature of 73° C., acid number of 213;

iv. 45.5% styrene/alpha methyl styrene/2-ethyl hexylacrylate/acrylic acid, molecular weight >200,000, glass transition temperature of 7° C. acid number of 50;

v. 45% styrene/alpha methyl styrene/acrylic acid/methyl methacrylate/butyl methacrylate/butyl acrylate, molecular weight >200,000, glass transition temperature of 64° C. acid number of 53;

vi. about 98.% solid styrene/alpha methyl styrene/acrylic resin which is cut into solution with 28% ammonia to pH of 7.85, molecular weight 17,000, glass transition temperature of 85° C. and acid number of 175:

vii. carboxylated water-soluble polymer having an acid number of 196;

viii. carboxylated water-soluble polymer having an acid number of 512;

ix. carboxylated water-soluble polymer having an acid number of 427: and x. mixtures thereof; and (e) the balance water, wherein the composition forms a non-tacky residue upon drying.

2. The carpet cleaning and restoring composition as claimed in claim 1, wherein the ethylene glycol n-hexyl ether is present in an amount of from about 1.0% to about 4.0% by weight of the composition.

3. The carpet cleaning composition as claimed in claim 1, wherein the ethylene glycol n-hexyl ether is present in an amount of about 2.5% by weight of the composition.

4. The carpet cleaning composition as claimed in claim 1, wherein the polymer is present in an amount of about 2.5% to about 3.5% by weight of the composition.

5. The carpet cleaning composition as claimed in claim 1, further comprising hydrogen peroxide.

6. The carpet cleaning composition as claimed in claim 5, wherein the hydrogen peroxide is present in an amount from about 0.3% to about 5.0% by weight of the composition.

7. The carpet cleaning composition as claimed in claim 5, wherein the hydrogen peroxide is present in an amount of about 1.0% by weight of the composition.

8. The carpet cleaning composition as claimed in claim 1 further comprising a co-solvent selected from the group consisting of diethylene glycol monohexyl ether, diethylene glycol monobutyl ether, isopropyl alcohol and mixtures thereof.

9. The carpet cleaning composition as claimed in claim 1 wherein the co-solvent is diethylene glycol monohexyl ether.

10. The carpet cleaning composition as claimed in claim 8, wherein the diethylene glycol monobutyl ether is present in an amount from about 0.5% to about 6.0% by weight of the composition.

11. The carpet cleaning composition as claimed in claim 10, wherein the diethylene glycol monobutyl ether is present in an amount from about 1.0% to about 3.0% by weight of the composition.

12. The carpet cleaning composition as claimed in claim 10, wherein the diethylene glycol monobutyl ether is present in an amount of about 2.5% by weight.

13. The carpet cleaning composition as claimed in claim 1, wherein the anionic surfactant is ammonium lauryl sulfate.

14. The carpet cleaning composition in claim 1, wherein the surfactant comprises a mixture of about 0.25% to about 1.0% by weight of an ethoxylated nonylphenol having a degree of ethoxylation of about 6, and from about 0.25% to about 1.0% by weight of an anionic surfactant selected from the group consisting of ammonium lauryl sulfate and sodium lauryl sulfate.

15. The composition as in claim 14, further comprising from about 0.5% to 2.0% by weight of a block copolymer of propylene oxide and ethylene oxide terminating in primary hydroxyl groups with an average molecular weight of 2,900.

16. The carpet cleaning composition as claimed in claim 1, wherein the polymer is present in an amount from about 1.0% to about 4.0% by weight of the composition.

* * * * *